United States Patent [19]

Ferns

[11] Patent Number: 4,498,804

[45] Date of Patent: Feb. 12, 1985

[54] MANHOLE/ACCESS COVER AND FRAME ASSEMBLIES

[75] Inventor: Derek Ferns, Monmouth, Wales

[73] Assignee: Selflevel Covers (Jersey) Limited, Jersey, Channel Islands

[21] Appl. No.: 459,095

[22] Filed: Jan. 19, 1983

[30] Foreign Application Priority Data

Jan. 20, 1982 [GB] United Kingdom ..... 8201582

[51] Int. Cl.[3] ..... E02D 29/14

[52] U.S. Cl. ..... 404/25; 52/20

[58] Field of Search ..... 404/25, 26, 4, 5, 52; 52/19, 20, 21; 137/364, 371; 210/163, 164; 277/213, 214, 215

[56] References Cited

U.S. PATENT DOCUMENTS

| | | | |
|---|---|---|---|
| 1,940,924 | 12/1933 | Taylor | 404/25 X |
| 3,218,942 | 11/1965 | Raquet | 404/26 |
| 3,367,071 | 2/1968 | MacLaren | 52/21 |
| 3,926,533 | 12/1975 | Binette | 404/26 |
| 3,999,335 | 12/1976 | Nagy et al. | 52/19 |
| 4,174,183 | 11/1979 | Ferns | 404/26 |

FOREIGN PATENT DOCUMENTS

| | | | |
|---|---|---|---|
| 2461348 | 7/1975 | Fed. Rep. of Germany | 404/25 |
| 118762 | 4/1947 | Sweden | 210/163 |
| 16260 | of 1891 | United Kingdom | 404/25 |
| 4790 | of 1901 | United Kingdom | 404/25 |
| 2013301 | 8/1979 | United Kingdom | 52/19 |
| 2097843 | 11/1982 | United Kingdom | 52/20 |

*Primary Examiner*—Stephen J. Novosad
*Assistant Examiner*—Beverly E. Hjorth
*Attorney, Agent, or Firm*—Young & Thompson

[57] ABSTRACT

In a manhole/access cover and frame assembly the cover is supported on the frame by pairs of downwardly facing, oppositely inclined support surfaces on the cover which are engageable respectively with corresponding upwardly facing, oppositely inclined support faces on the frame, and the cover has a substantially continuous downwardly facing ridged peripheral sealing surface which, when the cover is supported on the frame, overlies a substantially continuous upwardly facing ridged peripheral sealing surface on the frame. The engagement between the aforesaid support surfaces so locates the cover with respect to the frame that ridges on the sealing surfaces are interleaved but are held out of supporting contact with one another along substantially the whole of their length, so that the tortuous path between the ridges may be packed with grease to provide a gas and water tight seal.

12 Claims, 5 Drawing Figures

MANHOLE/ACCESS COVER AND FRAME ASSEMBLIES

BACKGROUND OF THE INVENTION

The invention relates to manhole/access cover and frame assemblies. The invention is particularly applicable to assemblies where both the cover and frame are formed from cast iron, but it is not limited to such assemblies.

It is frequently required that a manhole/access cover and frame assembly be rendered gas, air and water tight. This is normally required, for example, where the assembly is located within a domestic building area and covers, for example, a storm water or foul sewer chamber. In order to achieve the necessary seal it is conventional practice to provide the cover and frame with interengaging sealing surfaces which extend continuously around the periphery of the cover and between which surfaces a sealing compound, usually grease, may be spread to form an effective seal. In conventional assemblies of this type the interengaging sealing surfaces also provide the support for the cover within the surrounding frame so that, in theory, the cover is supported around the whole of its periphery. However, since the cover and frame are normally cast in iron, perfect accuracy in the shaping and finish of the sealing surfaces is difficult to achieve and, in practice, most frames and covers are slightly misshapen for one reason or another. Because of this misshaping there is a tendency for the cover to rock in the frame and such rocking will eventually break down the grease seal at the periphery of the frame, rendering it effective.

One method of overcoming this problem has been to ensure that the cover is firmly secured to the frame, for example by use of brass screws at the corners of a rectangular cover. The screws also have to be sealed where they enter the top of the cover and it will be appreciated that this solution is both expensive and inconvenient. An alternative solution has been to machine finish the engaging surfaces of the cover and frame to ensure a better fit than is given by the cover and frame as cast, but again this increases the cost of manufacture of the assembly.

The present invention sets out to provide a manhole/access cover and frame assembly which can provide a gas, air and water tight seal, without risk of rocking of the cover, and yet where the cover and frame may be used in the "as cast" condition.

SUMMARY OF THE INVENTION

According to the invention there is provided a manhole/access cover and frame assembly wherein the cover is supported on the frame by at least one pair of downwardly facing, oppositely inclined support surfaces on the cover which are engageable respectively with corresponding upwardly facing, oppositely inclined support faces on the frame, and wherein the cover has a substantially continuous downwardly facing peripheral sealing surface which, when the cover is supported on the frame, overlies a substantially continuous upwardly facing peripheral sealing surface on the frame, the engagement between the aforesaid support surfaces so locating the cover with respect to the frame that said peripheral sealing surfaces are held out of supporting contact with one another along substantially the whole of their length.

Thus, it will be seen that the cover is not supported in the frame by means of the sealing surfaces but is supported by inclined pairs of support surfaces which interengage with a wedging action so that the cover is firmly held against rocking movement. In the supported position of the cover the peripheral sealing surfaces are held out of contact with one another. In use of the assembly, grease or other sealing compound will be spread on the sealing surfaces before the cover is located on the frame so that when the cover is placed in position the slight gap between the sealing surfaces will be packed and filled with the sealing compound. Since the cover is held against rocking movement there will be no tendency for the seal to break down. The tolerances in dimensions required to ensure that the sealing surfaces are held out of supporting contact with one another along substantially the whole of their length are within the casting tolerances allowed by present known foundry techniques for good quality cast components.

Preferably the peripheral sealing surfaces on the cover and frame are formed with longitudinally extending ridges which overlap to define a tortuous space between the sealing surfaces. Preferably there is formed on one sealing surface at least one ridge which projects between two ridges on the other sealing surface.

The frame may be formed with an upstanding peripheral wall located outwardly of the peripheral sealing surfaces, the inner surface of the wall being closely adjacent, but spaced from, an outer peripheral edge surface of the cover when the cover is supported by the frame. Preferably the top of the wall is substantially flush with the top of the cover. With such an arrangement, in use, the sealing compound may then also fill the gap between the wall and the outer peripheral edge surface of the cover.

The assembly may comprise a single frame supporting a single cover, or it may comprise a single frame supporting a plurality of covers. In the latter case the frame may include one or more support bars each extending across the frame between two adjacent covers to support the adjacent edges of said covers, each support bar also having an upwardly facing sealing surface to cooperate with the corresponding portions of the peripheral sealing surfaces of said covers.

Although each support bar may be integrally formed with a main part of the frame, it is preferably separately formed and connected to the main part of the frame at opposite ends of the support bar. For example, each end of the support bar may be formed with a pair of downwardly facing, oppositely inclined support surfaces which are engageable with corresponding upwardly facing, oppositely inclined support surfaces on the main part of the frame. It will be appreciated that in such an arrangement the ends of the support bar will be firmly supported against rocking by the wedging action of the interengagement between the support surfaces.

In the last mentioned arrangement, each end of the support bar may be formed with a sealing surface which overlies a corresponding sealing surface on the main part of the frame but is held out of contact therewith when the support bar is fitted to the main part of the frame. The cooperating sealing surfaces on the support bar and frame may, like the peripheral sealing surfaces, be formed with ridges which overlap to define a tortuous space between the sealing surfaces. Again, there is preferably formed on one sealing surface at least one ridge which projects between two ridges on the other sealing surface.

In any of the arrangements described above the peripheral sealing surface on the frame, and said upstanding peripheral wall where such is provided, may be formed on a plurality of elongate elements which are separately formed from a main part of the frame and are connected thereto.

In any of the above arrangements the frame of the assembly may comprise a number of separately formed frame members secured together.

DETAILED DESCRIPTION OF THE PREFERRED EMBODIMENTS

Figure 1:
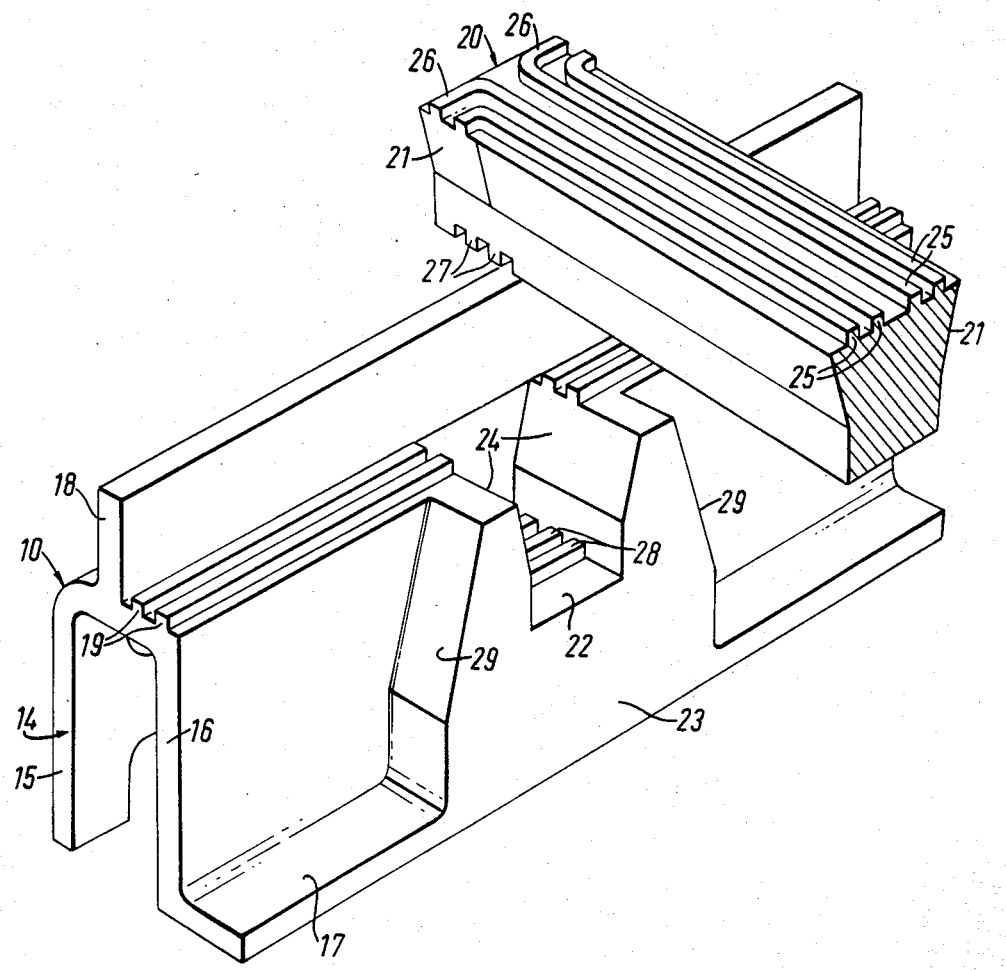
FIG. 1 is a perspective view of part of the frame of a cover and frame assembly.
Figure 2:
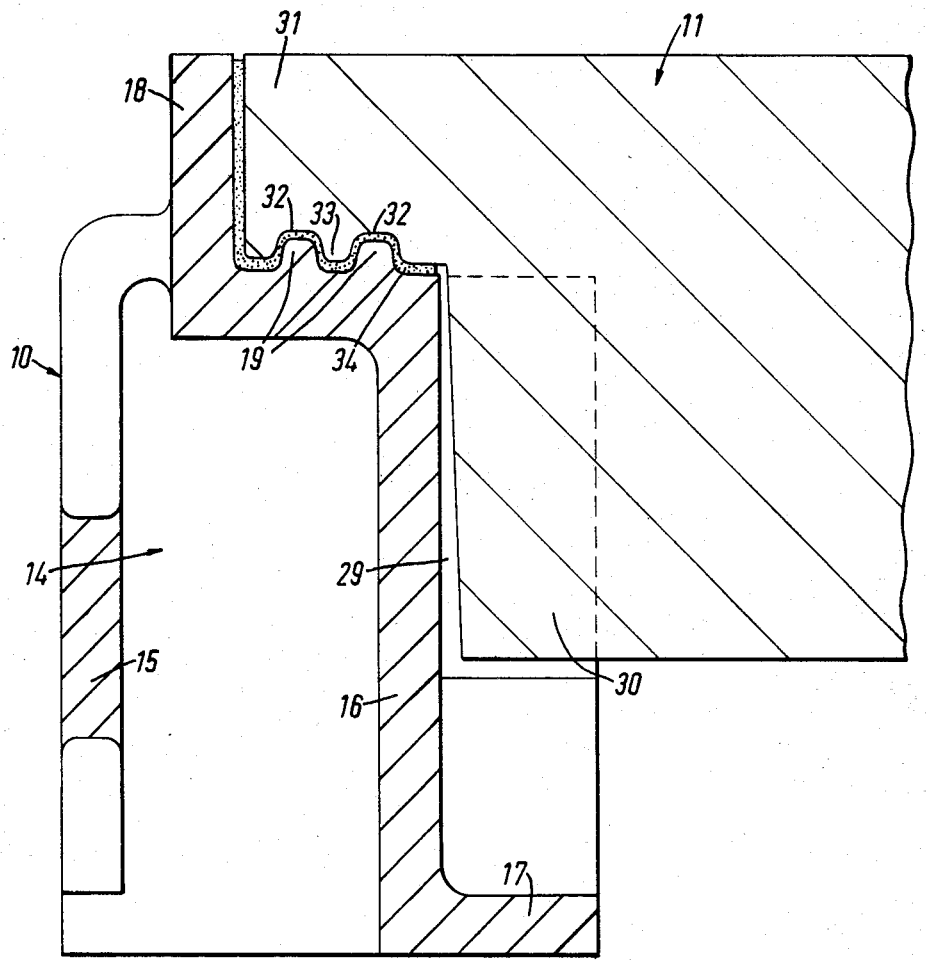
FIG. 2 is a vertical section through one side member of a frame and part of a cover supported thereon.
Figure 3:
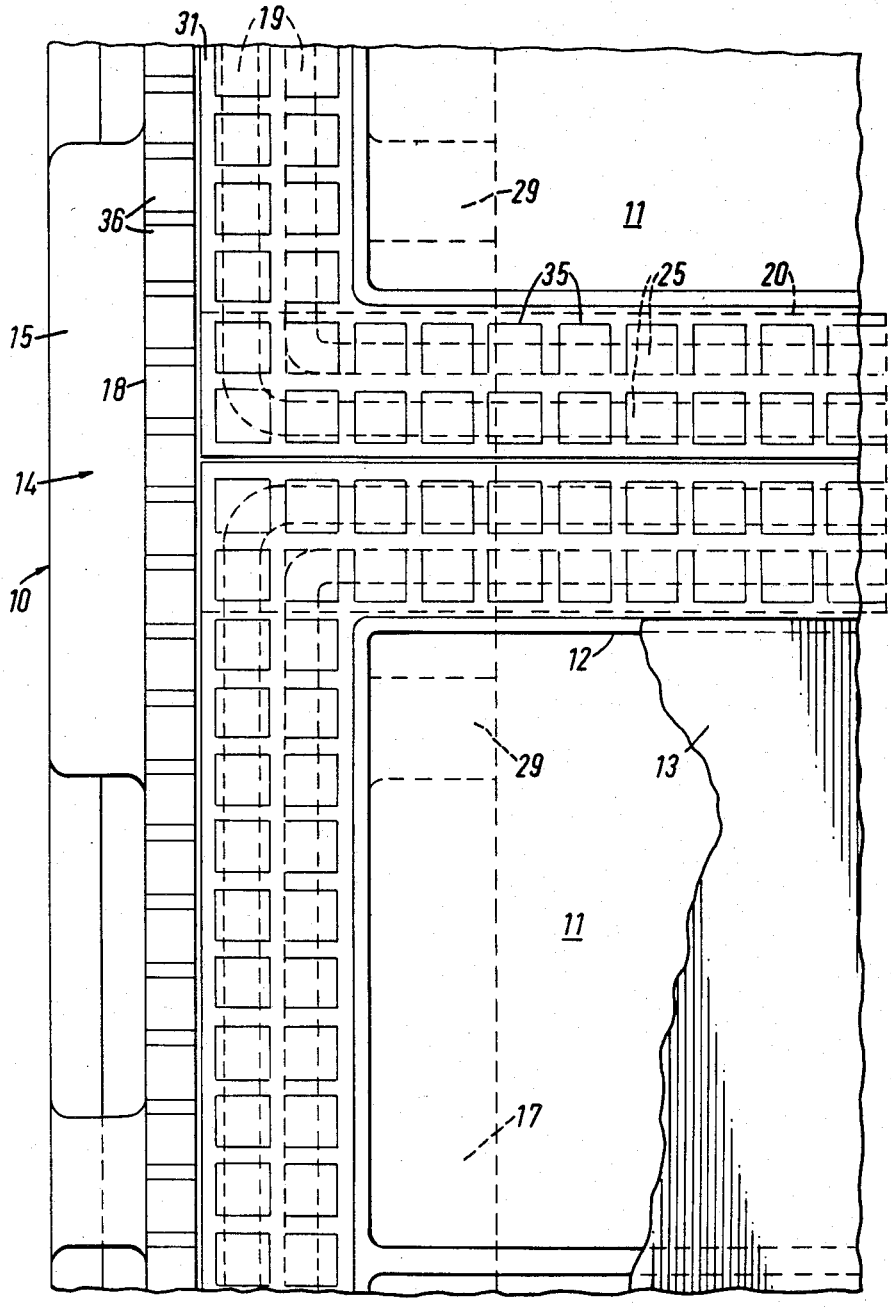
FIG. 3 is a plan view of part of an assembled cover and frame assembly in which a number of covers are supported on a single frame.

Referring to FIGS. 1 to 3 of the drawings, a manhole cover and frame assembly comprises a rectangular frame 10 supporting two or more rectangular covers 11, both the frame and the covers being formed from cast iron. The centre portions of the covers may be formed with recessed areas 12 to receive a concrete filling, indicated at 13.

The frame 10 may be integrally formed in one piece or may be formed from elongate side members and end members secured together. A side frame member is indicated generally at 14 in the drawings. The end frame members, not shown, are of similar construction.

As best seen in FIGS. 1 and 2, each side frame member 14 is generally of inverted U-shape in cross-section the outer and inner flanges of the U being indicated at 15 and 16 respectively. A horizontal flange 17 projects inwardly from the lower edge of the inner flange 16 and an upstanding peripheral wall 18 extends upwardly from the top web of the side member.

Disposed inwardly adjacent the peripheral wall 18 of the side member is a peripheral sealing surface formed with two upstanding ridges 19 which extend longitudinally of the side member 14. The sealing surface, and the ridges 19 formed thereon, extend continuously around the side and end members of the frame, as does also the wall 18.

At the junction between the two covers 11 to be supported by the frame, a support beam 20 extends across the frame from one side member 14 to the other (not shown). As best seen in FIG. 1, the support beam 20 is formed at its opposite sides with two downwardly inclined support surfaces 21. Each end of the beam is received in a recess 22 formed in a projection 23 on the inner flange 16 of the side member. The upper parts of the sides of the recess 22 are formed with upwardly inclined support surfaces 24 which mate with the inclined support surfaces 21 on the end of the beam 20 when it is received within the recess 22. The interengaging inclined support surfaces 21 and 24 thus locate the end of the beam securely within the recess with a wedging action, thus preventing rocking of the beam.

The upper surface of the beam 20 is formed with two pairs of longitudinally extending parallel ridges 25 which are turned through 90° in opposite directions at each end of the beam, as indicated at 26, so as to line up with the ridges 19 extending longitudinally of the side member 14.

The underside of each end of the support beam 20 is formed with three transverse grooves which define two downwardly extending ridges 27 which, when the support beam 20 is engaged within the recess 22, become interleaved with corresponding upwardly projecting ridges 28 on the floor of the recess. The dimensions of the components are such that when the support beam 20 is engaged with the side frame member the interleaving ridges 27 and 28 remain slightly out of contact with one another. Before the support beam is fitted into the recess 22 the grooves between the ridges 27 and 28 are filled with a sealing compound, such as grease, which then packs and fills the gaps betwen the ridges when the support beam is in position.

The opposite sides of the projection 23 on the side frame member 14 are formed with upwardly and oppositely inclined support faces 29. Similar support faces are formed on further projections (not shown) at spaced intervals along the side member 14, and on one side only of projections adjacent the corners of the frame.

The inclined support surfaces 29 on the frame member cooperate with corresponding inclined surfaces on downwardly extending projections 30 (see FIG. 2) at the sides of the covers 11. The mating inclined support surfaces serve to support the covers on the frame with a wedging action, thus ensuring that the covers do not rock when in position on the frame. It will be appreciated that the required number and disposition of the projections 23 and 30 will depend on the size and number of the covers to be supported on the frame.

As best seen in FIGS. 2 and 3, the upper part of each cover 11 is formed with an outwardly projecting peripheral flange 31 which is of such a width that its outer edge is closely adjacent, but spaced from, the upstanding peripheral wall 18 on the side frame member. The upper surface of the cover 11 is substantially flush with the upper edge of the wall 18.

The under surface of the peripheral flange 31 is formed with two parallel longitudinal grooves 32 which define between them a downwardly projecting ridge 33 which extends continuously around the periphery of the cover. The depth of the flange 31, and the location of the inclined support surfaces 29 and 30, are such that when the support surfaces are engaged to support each cover 11 on the frame, the ridge 33 on the underside of the flange 31 on the cover projects downwardly between the upstanding ridges 19 on the side frame member, as shown in FIG. 2, but the underside of the flange and the adjacent parts of the side member remain out of contact with one another around substantially the whole periphery of the cover. A tortuous space 34 is thus provided between the sealing surfaces on the flange 31 and the side member 14.

Before the covers are fitted to the frame, the ridges 19 on the side and end frame members and the underside of the flange 31 are smeared with sealing compound, such as grease, to fill the grooves between the ridges. Thus, when the covers are applied to the frame the grease fills the tortuous space 34 around the periphery of each cover and forms an effective gas, air and water tight seal. As shown in FIG. 2 the grease may also fill the gap between the peripheral wall 18 and the outer peripheral edge of the cover 11.

It will thus be seen that the described arrangement provides an effective gas, air and water tight seal around the periphery of the covers in a cover and frame assembly, while at the same time ensuring that the covers are secured against rocking movement. This is achieved using "as cast" components without the necessity of any machining of the components.

Interengaging ridges, to be packed with grease, may also be provided on the mating inclined support surfaces 29 and 30 to improve the seal further.

Although in the arrangement shown in the drawings the ridges 19 and peripheral wall 18 are integrally formed with the side member 14, they could also be formed on separate elongate strips which are bolted or otherwise secured to the side and end frame members.

The marginal portions of the covers 11, and the upper edge of the peripheral wall 18 may be formed with non-slip formations as indicated at 35 and 36 respectively in FIG. 3.

Although the above described arrangement shows a number of covers mounted on a single frame, it will be appreciated that a similar arrangement may be employed for mounting a single cover on a single frame. In this case no support beams 20 are required since all four sides of the cover are supported on the side and end frame members.

Although the invention has been described in relation to rectangular covers and frames, it will be appreciated that it is also applicable to circular covers and frames, as well as to other shapes.

Figure 4:
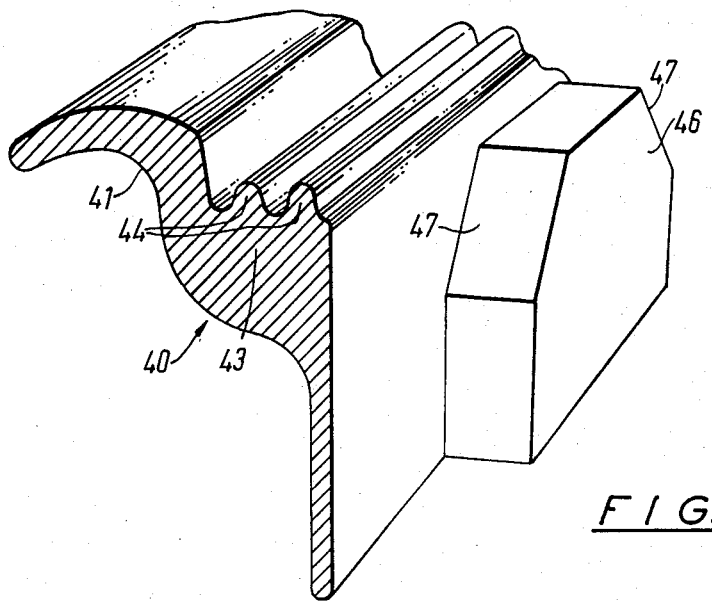
FIG. 4 is a part-sectional perspective view of a portion of a self-levelling frame of an assembly according to the invention.
Figure 5:
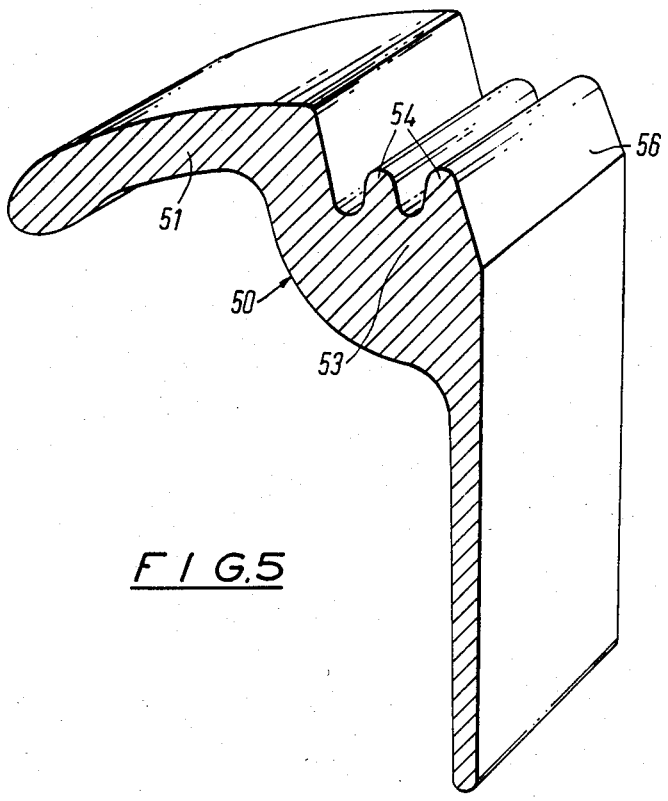
FIG. 5 is a similar view to FIG. 4 of an alternative form of self-levelling frame.

FIGS. 4 and 5 show the application of the invention to manhole cover and frame assemblies of the self-levelling kind. The frame may be circular or rectangular, and a circular frame will be described by way of example. In each case the frame 40 or 50 has an outwardly projecting continuous peripheral flange 41 or 51.

To set the frame in a road surface there is first located below the level of the road surface a rectangular section concrete ring beam (not shown) and the circular frame initially rests on the ring beam. As surfacing material is applied to the road around the frame, and is rolled, the material flows inwardly beneath the flange 41 or 51 and lifts the frame until it is automatically brought to the level of the road surface.

The upwardly facing inner peripheral ledge 43 or 53 on the frame 40 or 50 is formed with parallel upstanding ridges 44 or 54 which cooperate with parallel peripheral ridges around the underside of the manhole cover (not shown).

In the arrangement shown in FIG. 4, the frame 40 is formed with a number of inward projections 46 spaced around its inner periphery. The opposite sides of each projection are formed with upwardly and oppositely inclined support faces 47. The inclined support faces 47 cooperate with corresponding inclined surfaces on the underside of the cover (not shown). The mating inclined support faces on the cover and frame serve to support the cover on the frame with a wedging action, thus ensuring that the cover does not rock when in position on the frame. When the cover is thus supported on the frame, the ridges on the underside of the cover and the ridges 44 on the frame, although interleaved, are held out of contact with one another around substantially the whole periphery of the cover so that a tortuous space is provided between the ridges.

As in the previously described arrangement the ridges are smeared with sealing compound, such as grease, before the cover is applied to the frame to fill the space between the ridges to provide an effective gas, air and water tight seal.

In the alternative arrangement of FIG. 5, the inner periphery of the frame is formed with a continuous angled face 56 which mates with a correspondingly angled continuous face around the underside of the cover (not shown). As in the previously described arrangement, the mating angled faces support the cover with the interleaved ridges on the cover and frame out of contact with one another to form a tortuous space to be filled with grease.

In the arrangements according to the invention the interleaved sealing ridges may be of any suitable cross-section. For example the ridges in FIG. 1 are of square cross-section, the ridges in FIG. 2 are of rounded cross-section, and the ridges of FIGS. 4 and 5 have inclined sides. In another alternative arrangement (not shown), the outer side face of each ridge on the frame is vertical and the inner side face is inclined. Arrangements where one or both side faces of the ridges are inclined are preferred, since this eases removal of the cover from the frame.

Instead of the interleaved ridges being packed with grease or other sealing compound, or in addition thereto, sealing may be effected by placing within the grooves between the ridges sealing strips of rubber, neoprene, plastics, fibre or other suitable resilient sealing material.

It will be seen that in all the arrangements according to the invention, the support faces for the cover are quite separate from the sealing faces, whereas in conventional assemblies sealing is effected by the same surfaces which support the cover. The present invention therefore allows the use, in a sealed assembly, of inclined support seatings (particularly the non-rocking seating known as a "Gloster" seating). Furthermore, since the sealing surfaces are separate from the support surfaces, they may be located in any position with respect to the support surfaces. In particular, in the arrangements shown in the drawings, the support surfaces are located below the level of the sealing surfaces. This is a most important and advantageous feature of the present invention since it allows ready access to the sealing surfaces, which are in the upper part of the assembly, whereas in conventional known arrangements, the combined sealing and support surfaces are necessarily in the lower part of the assembly.

I claim:

1. A manhole/access cover and frame assembly wherein the cover is supported on the frame by at least one pair of downwardly facing, oppositely inclined support surfaces on the cover which are engageable respectively with corresponding upwardly facing, oppositely inclined support faces on the frame, and wherein the cover has a substantially continuous downwardly facing peripheral sealing surface which, when the cover is supported on the frame, overlies a substantially continuous upwardly facing peripheral sealing surface on the frame, the engagement between the aforesaid support surfaces so locating the cover with respect to the frame that said peripheral sealing surfaces are held out of supporting contact with on another along the whole of their length and width, the peripheral sealing surfaces on the cover and frame having longitudinally extending ridges which interfinger to define a space of tortuous cross section between the sealing surfaces, said support faces being inclined in the direction of the longitudinal extent of said ridges, and grease disposed between said peripheral sealing surfaces, said space being open to the ambient in both directions laterally of said ridges whereby said grease can extrude from said space at both ends of said tortuous cross section.

2. An assembly according to claim 1, wherein the frame is formed with an upstanding peripheral wall located outwardly of the peripheral sealing surfaces, the inner surface of the wall being closely adjacent, but spaced from, an outer peripheral edge surface of the cover when the cover is supported by the frame.

3. As assembly according to claim 2, wherein the top of the wall is substantially flush with the top of the cover.

4. An assembly according to claim 1, comprising a single frame supporting a plurality of covers.

5. An assembly according to claim 4, wherein the frame includes at least one support bar extending across the frame between two adjacent covers to support the adjacent edges of said covers, each support bar also having an upwardly facing sealing surface to co-operate with the corresponding portions of the peripheral sealing surfaces of said covers.

6. An assembly according to claim 5, wherein each support bar is separately formed and connected to the main part of the frame at opposite ends of the support bar.

7. An assembly according to claim 6, wherein each end of the support bar is formed with a pair of downwardly facing, oppositely inclined support surfaces which are engageable with corresponding upwardly facing, oppositely inclined support surfaces on the main part of the frame.

8. An assembly according to claim 7, wherein each end of the support bar is formed with a sealing surface which overlies a corresponding sealing surface on the main part of the frame but is held out of contact therewith when the support bar is fitted to the main part of the frame.

9. An assembly according to claim 7, wherein the co-operating sealing surfaces on the support bar and frame are formed with ridges which overlap to define a tortuous space between the sealing surfaces.

10. An assembly according to claim 9, wherein there is formed on one sealing surface of the support bar and frame at least one ridge which projects between two ridges on the other sealing surface.

11. An assembly according to claim 1, wherein the peripheral sealing surface on the frame is formed on a plurality of elongate elements which are separately formed from a main part of the frame and are connected thereto.

12. An assembly according to claim 1, wherein there is formed on one sealing surface plural ridges each of which projects between two ridges on the other sealing surface.

* * * * *